United States Patent [19]

Apelain et al.

[11] Patent Number: 4,902,475

[45] Date of Patent: Feb. 20, 1990

[54] ALUMINUM ALLOY AND MASTER ALUMINUM ALLOY FOR FORMING SAID IMPROVED ALLOY

[75] Inventors: Diran Apelain, Penn Valley, Pa.; Jung-Jen A. Cheng, East Brunswick, N.J.

[73] Assignee: Metallurgical Products & Technologies, Inc., Exton, Pa.

[21] Appl. No.: 102,839

[22] Filed: Sep. 30, 1987

[51] Int. Cl.[4] ..... C22C 21/02

[52] U.S. Cl. ..... 420/548; 420/549

[58] Field of Search ..... 420/548, 549; 148/415, 148/437

[56] References Cited

U.S. PATENT DOCUMENTS 1,934,281 11/1933 Stay ..... 420/548

*Primary Examiner*—R. Dean

*Attorney, Agent, or Firm*—Louis Weinstein

[57] ABSTRACT

An Al-Si base alloy to which is added predetermined amounts of Ti, preferably in the range from 0.2 to 1.0 weight percent Ti to significantly improve grain refinement and eutectic modification and to improve soundness and ductility of castings made of such an alloy, as well as reducing wear resistance of the casting. An Al-Ti or Al-Ti-B master alloy is utilized to produce the aforesaid alloy and is added to the melt to achieve the desired Ti level to produce a hypoeutectic and hypereutectic alloys. Alternatively, an Al-Ti-Si master alloy is added to the melt to obtain the desired Ti level for producing hypereutectic alloys.

4 Claims, 4 Drawing Sheets

0.5 W/O Ti 0.2 W/O Ti FIG. 2a
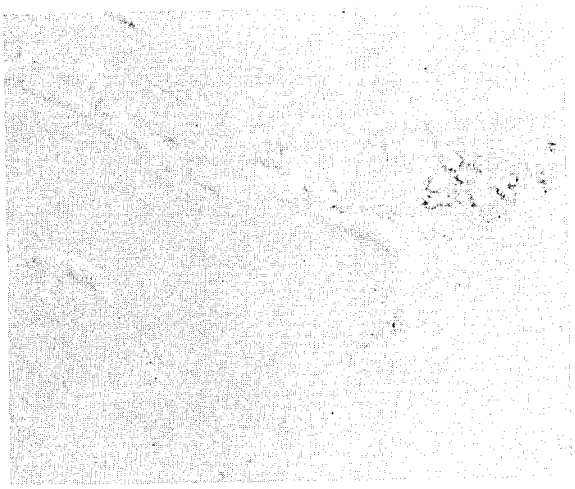
50μm
0.5 W/O Ti FIG. 2b
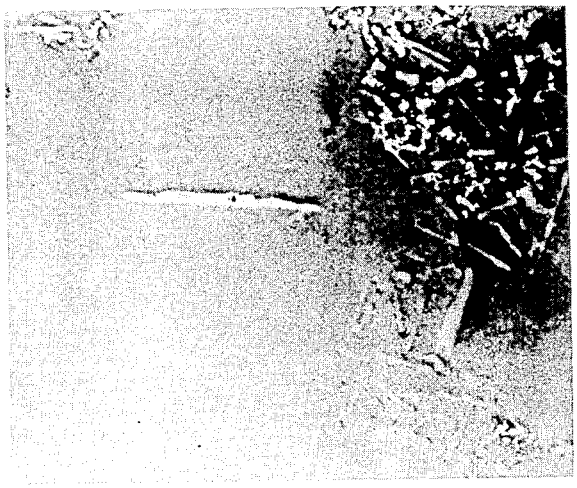
50μm
1 W/O Ti FIG. 2c
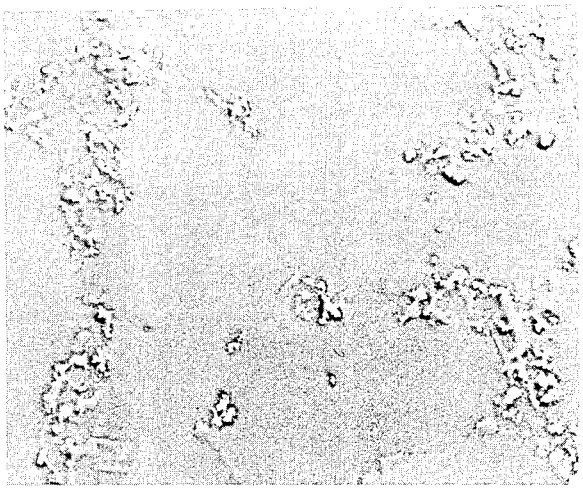
50μm A 390 (VIRGIN)
NO Ti B 300μm Ti=0.18 W/O
B=0.03 W/O 300μm 100μm 100μm 300μm 300μm 100μm 100μm

ALUMINUM ALLOY AND MASTER ALUMINUM ALLOY FOR FORMING SAID IMPROVED ALLOY

FIELD OF THE INVENTION

The present invention relates to aluminum casting alloys and more particularly to method and apparatus for producing aluminum alloys for use in casting to provide significant improvements in grain refinement, eutectic modification and wear resistance and further related to the provision of a master alloy for producing an aluminum casting alloy having the aforementioned advantageous characteristics.

BACKGROUND OF THE INVENTION

Aluminum-silicon (Al-Si) based alloys are widely used as foundry alloys for a variety of different applications. For example, engine blocks and pistons for air compressors employed in the automotive industry are cast from Al-Si based alloys. Casting alloys are distinguished from wrought alloys which contain 95% or more aluminum and are not used for castings but are used for applications such as can stock, gutters, siding, airplane skins, etc. Casting alloys can be broken down into two general categories:

(a) Hypoeutectic alloys which contain silicon in weight percent amounts of up to but less then 12 percent; and (b) Hypereutectic alloys which contain more than 12 percent by weight of silicon.

Typical hypoeutectic foundry alloys are alloys identified in the trade by the nomenclature A319 and A356 alloys, which contain approximately 7 percent by weight of silicon. In a similar fashion, a typical hypereutectic foundry alloy is identified by the nomenclature A390 alloy which contains approximately 17 percent by weight of silicon. In addition to alleviating the formation of defects such as shrinkage of the alloy, and porosity due to the gases and also to minimize the presence of inclusions, two very significant ways in which the strength and performance of an aluminum casting alloy can be improved is through grain refinement of the alloy and modification of the eutectic structure.

Grain refinement is simply the process of adding nuclei to the melt prior to pouring, such that upon the freezing process (i.e., the solidification journey) the casting will expedite a fine grained microstructure. Grain refinement is accomplished by adding master alloys containing titanium (Ti) and/or boron (B).

Eutectic modification, on the other hand, is the process of changing the morphology of the cast structure; moreover, that portion of the cast alloy which freezes last. In other words, the last liquid to freeze which is of eutectic composition, if unmodified, will result in a cast structure containing large acicular and deleterious Si-rich crystals. The morphology of these Si crystals is modified (hence the term modification) by the addition of sodium, or strontium, or antimony to the melt, to alter the eutectic structure and to yield fine Si-rich crystals having a fibrous structure.

BRIEF DESCRIPTION OF THE INVENTION INCLUDING THE PROBLEMS ENCOUNTERED WITH PRESENT-DAY ALLOYS AND THE MANNER IN WHICH THESE PROBLEMS ARE SOLVED BY THE PRESENT INVENTION

In order to obtain grain refinement in hypoeutectic Al-Si based alloys, Ti, which is obtained by adding master alloys Al-Ti, Al-Ti-B or salts, such as for example Al-5~10w/oTi, Al-3~10w/oTi-0.1~3w/oB, $KBF_4$, $K_2TiF_6$ and $Na_2B_4O_7$, is added to the alloy. This is a conventional technique employed in the aluminum industry to grain refine aluminum foundry alloys such as, for example, A356 alloy. The maximum level of Ti added commercially is approximately 0.15 percent by weight, which has been found to reduce grain size of sand castings from 3 mm (in the presence of 0 percent Ti) to approximately 0.4 mm. In addition to yielding fine grains, grain refinement improves feeding, helps fluidity and increases the strength and density of the casting. However, it has been shown that Ti levels of up to 0.15 percent by weight have no effect on the eutectic Si phases. Thus, the problems of low level of ductility and soundness (due to solidification shrinkage), and the required long homogenization times due to the presence of large acicular eutectic Si phases cannot be solved by grain refinement alone.

In order to achieve eutectic modification, eutectic modifiers such as sodium, strontium and antimony are commercially used to change the morphology of the eutectic Si crystals from coarse acicular to a fine fibrous structure, to improve ductility, soundness and homogenization. Antimony, which is used principally in Europe and Japan, has been shown to decrease casting properties when the cooling rate is low (i.e. the ductility of the casting is degraded). In addition, antimony forms poisonous hydrides which are environmentally unsafe. The effects of sodium and strontium have unfortunately been found to fade due to oxidation losses, thus, complicating the control of the modification process and making reproducibility extremely difficult. Furthermore, the above-mentioned modifiers have no effect on grain refinement of the hypoeutectic Al-Si alloys.

In the case of hypereutectic alloys, it has been shown that the wear properties of the A390 alloy, for example, is highly dependent upon the number and distribution of primary Si-rich particles present in the alloy. The wear characteristics of the A390 alloy is improved by increasing the number and uniformity of the Si-rich particles. Phosphorous has been used commercially to refine the Si-rich crystal, and consequently increases the number and uniformity of Si-rich particles. However, the addition of phosphorous decreases the soundness and ductility of the aluminum casting. Adding strontium to an A390 alloy may modify the eutectic structure, which in turn improves casting quality, but strontium interacts with phosphorous and decreases the refinement of the Si-rich intermetallic particles, thereby reducing the wear resistance of the aluminum alloy casting.

The present invention overcomes the problems encountered in the grain refinement and eutectic modification techniques presently being employed in hypoeutectic alloys, and it accomplishes both grain refinement and eutectic modification in one single step by adding 0.2 to 1.0 percent by weight Ti to the melt. This "over-grain-refined" state provides a casting with fine grains and a modified eutectic structure.

In hypereutectic alloys the morphology of the primary silicon-rich phase, which is the first phase to freeze, as well as the morphology of the last liquid to freeze (of the eutectic composition) is altered and improved by adding Ti in the amount of 0.2 to 1.0 weight percent. This technique reduces the porosity level and also decreases the size and distribution of the primary silicon-rich phase, and since the volume fraction of the phase is the same as when the melt is non-treated with titanium, the number of these phases is increased and their morphology is more rounded, vis-a-vis the large blocky phases encountered in the untreated metal. The eutectic structure, which surrounds the silicon-rich primary crystals, is modified, and the deleterious long acicular eutectic phases are transformed to a finer and more uniformly distributed eutectic phase.

The above changes increase the performance of the casting in terms of mechanical properties, and particularly wear resistance and ductility, as well as the enhanced properties of the melt during pouring. Fluidity, porosity and feeding of the casting melt is greatly improved by treating hypereutectic alloys with the addition of 0.2 to 1.0 percent by weight Ti. In addition, the machinability of the resultant casting is improved by the above described treatment.

The treatment of hypereutectic alloys is best accomplished through the utilization of an Al-Si-Ti master alloy which may be added to hypereutectic alloy, such as A390 alloy. The addition of a new master alloy beneficially changes the size, distribution and morphology of both the primary silicon-rich phase and the eutectic structure.

OBJECTS OF THE INVENTION ND BRIEF DESCRIPTION OF THE FIGURES

It is therefore one object of the present invention to provide an aluminum casting alloy which is treated in such a way as to provide the alloy with greater wear resistance, significantly improved ductility, significantly improved fluidity of alloy melt and improvement in the machinability of the resulting casting.

Another object of the present invention is to provide an aluminum casting alloy having the advantages described hereinabove by treating the alloy to improve grain refinement and eutectic modification.

Still another object of the present invention is to provide an aluminum casting alloy having the advantageous characteristics described hereinabove through the addition of a predetermined amount by weight percent of Ti which amount is significantly greater than that amount conventionally employed in present day aluminum casting alloys.

Still another object of the present invention is to provide an aluminum casting alloy having the advantages described hereinabove which accomplished through the addition of at least 0.2 percent by weight of titanium to a hypoeutectic aluminum casting alloy to achieve the aforementioned advantages.

Still another object of the present invention is to provide an aluminum casting alloy having the advantages described hereinabove in which approximately 0.2 to 1.0 percent by weight of titanium is added to a hypereutectic aluminum casting alloy to achieve the aforementioned advantages.

Still another object of the present invention is to provide an Al-Ti-Si master alloy for forming hypereutectic aluminum casting alloys having the advantageous characteristics recited hereinabove.

The above as well as other objects of the present invention will become apparent when reading the accompany description and figures in which:

FIGS. 1*a* and 1*b* show a hypoeutectic casting alloy to which has been respectively added no titanium and approximately 0.5 weight percent titanium.

FIGS. 2*a* through 2*c* are photomicrographs of a hypoeutectic alloy to which has been respectively added approximately 0.2, 0.5, and 1.0 weight percent of titanium.

FIGS. 3*a* and 3*b* are photomicrographs of A390 alloy containing no titanium.

FIGS. 4*a* and 4*b* are photomicrographs showing A390 alloy containing 0.18 percent by weight of titanium an 0.03 percent by weight of boron.

FIGS. 5*a* and 5*b* are photomicrographs of the A390 alloy containing 0.527 percent by weight of titanium and 0.082 percent by weight of boron.

FIGS. 6*a* and 6*b* show A390 alloy containing 0.84 percent by weight of titanium and 0.13 percent by weight of boron.

DETAILED DESCRIPTION OF THE INVENTION AND THE PREFERRED EMBODIMENTS THEREOF

Figure 1A:
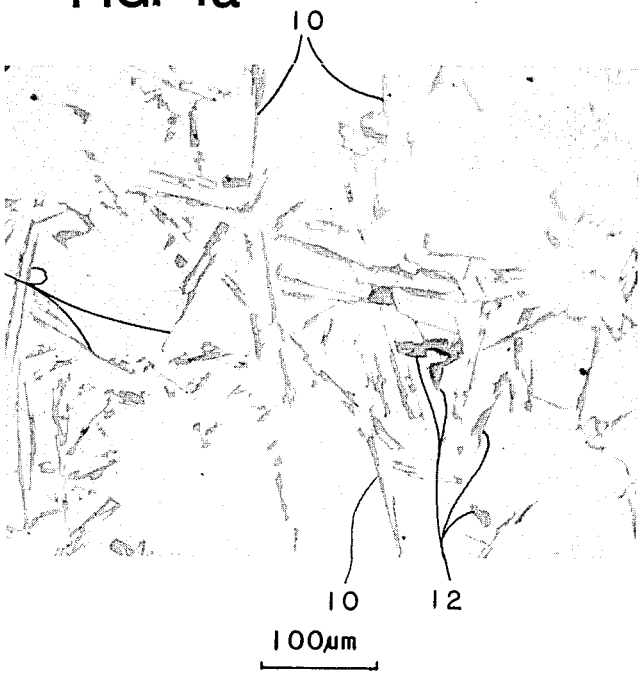

As was described hereinabove, it is extremely advantageous to be able to provide aluminum casting alloys which have excellent fluidity, porosity and feeding properties as well as improved machinability of the resultant casting and greatly improved wear resistance. Present day techniques have not yielded the desired objectives. For example, the use of antimony is undesirable since the antimony forms poisonous hydrides as well as degrading the casting properties. The effects of sodium and strontium have been found to fade due to oxidation losses and these modifiers have further been found to have no effect on grain refinement.

In the case of hypereutectic alloys, phosphorous has been found to decrease the soundness and ductility of the casting. The use of strontium for modifying the eutectic structure improves the casting quality but interacts with the phosphorous to decrease grain refinement and thus reduce wear resistance of the casting.

The present invention overcomes the disadvantages of the techniques presently in use wherein both grain refinement and eutectic modification are carried out in a single step.

The method and technique of the present invention are as follows:

For hypoeutectic alloys, a master alloy of Al-Ti or Al-Ti-B and salts (i.e. alloy bearing elements) which more specifically are comprised of Al-5~10w/oTi, Al-3~10w/oTi-0.1~3w/oB, $KBF_4$, $K_2TiF_6$ and $Na_2B_4O_7$ are added to the hypoeutectic alloy melt in order to achieve a Ti level of between 0.2 to 1.0 and preferably 0.5 percent by weight. The master alloys or salts can be added either when the molten metal is in the cricuible or is in the ladle before pouring.

The weight percent of the Al-Ti master alloy is 89.0 to 95.5 weight percent of aluminum and 11.0 to 4.5 weight percent of titanium. The Al-Ti-B master alloy is 85.5 to 97.4 weight percent of aluminum; 11.0 to 2.5 weight percent of titanium and 3.5to 0.1 weight percent of boron; and usually less than 1 percent by weight of the impurities normally encountered in Al-Si casting alloys. The master alloy can alternatively be in the form of salts such as Titanium Alkalifluride and Alkali borofluoride, $K_2TiF_6$ and $KBF_4$. In the case of the Al-Ti master alloy, containing 89.0–95.5 weight percent of aluminum and 11.0–4.5 weight percent of titanium, the amount of the master alloy added to the melt, for example, in the case of A356 aluminum alloy is 1.9–29 weight percent of the master alloy to the melt or alternatively 1 part of the master alloy to 52–3.5 parts of the molten alloy.

In the case of the Al-Ti-B master alloy containing 85.5–97.4 weight percent of aluminum, 11.0–2.5 weight percent of titanium and 3.5–0.1 weight percent of boron, 1.9–67 percent by weight of the Al-Ti-B is added to the melt or alternatively, 1 part of the Al-Ti-B master alloy is added to 52–1.5 parts of the hypoeutectic alloy.

For hypereutectic alloys, titanium is added thereto by addition of a master alloy of Al-Ti, Al-Ti-B or Al-Ti-Si, which more specifically are comprised of Al-5~10w/oTi, Al-3~10w/oTi-0.1~3w/oB or Al-4~8w/oTi-8~16w/oSi, in order to achieve a Ti level in the melt ranging between 0.2 to 1.0 percent by weight. The master alloys can be added either when the molten metal is in the crucible or is in the ladle before casting.

In the case of the Al-Ti master alloy, continuing 89.0–95.5 weight percent of aluminum and 11.0–4.5 weight percent of titanium, the amount of the master alloy added to A390 alloy is 1.9–29 weight percent of the master alloy to the melt or alternatively 1 part of the master alloy to 52–3.5 parts of the molten alloy.

In the case of the Al-Ti-B master alloy containing 85.5–97.4 weight percent of aluminum, 11.0–2.5 weight percent of titanium and 3.5–01 weight percent of boron, 1.9–67 percent by weight of the Al-Ti-B is added to the melt or alternatively, 1 part of the Al-Ti-B master alloy is added to 52–1.5 parts of the hypereutectic alloy.

In the case of the Al-Si-Ti master alloy, the range of the compositions for the master alloy are Al-4w/oTi-8w/oSi to Al-8w/oTi-16w/oSi.

The significant effects of the present invention can better be understood by a consideration of FIGS. 1 through 6 which show photomicrographs of the alloys which have been treated according to both conventional techniques and the techniques of the present invention.

Figure 1B:
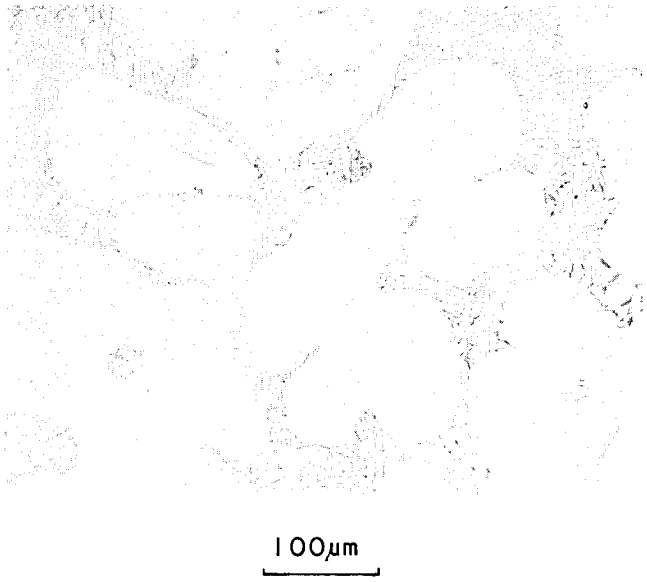

FIG. 1*a* shows a photomicrograph of a hypoeutectic alloy containing no (0 percent) titanium. The light area represents aluminum rich (98 to 100 percent aluminum by weight) while the black areas represent silicon rich (99 to 100 percent silicon by weight). The scale between FIGS. 1*a* and 1*b* is the same for both of these figures. In the absence of titanium (FIG. 1*a*) the silicon forms large acicular (needle-like) Si-rich crystals 10 and 12.

The treatment of the same hypoeutectic Al-Si alloy with 0.5 percent by weight titanium results in significant grain refinement and eutectic modification. The Si crystals of FIG. 1*b* are significantly reduced in size as compared with those shown in FIG. 1*a* and the large Si-rich crystals, found in FIG. 1*a* are almost non-existent as shown in FIG. 1*b*.

Figure 3A:
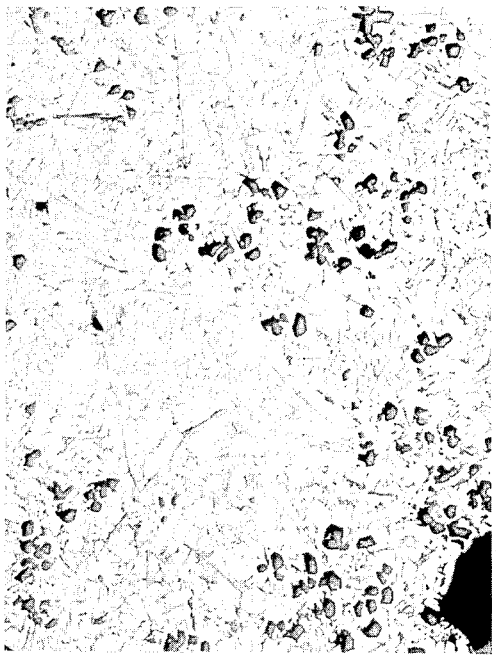
Figure 3B:
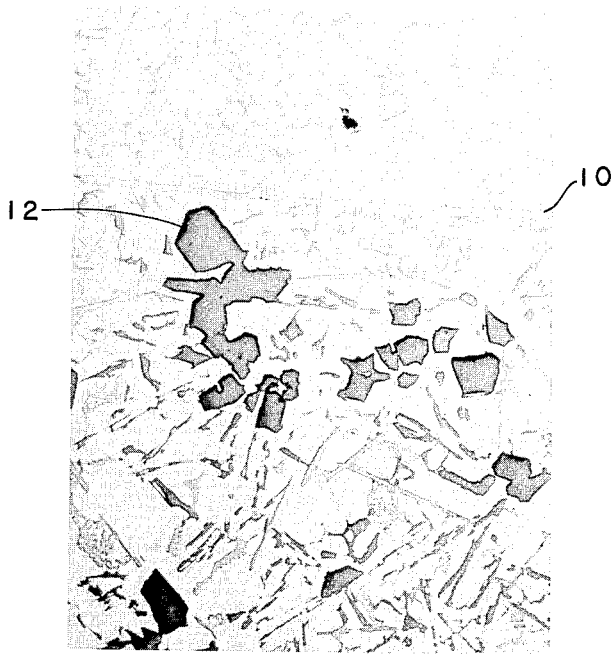

A hypereutectic alloy, A390 aluminum and which contains 0 percent titanium and 0 percent boron is shown in FIGS. 3*a* and 3*b*. FIG. 3*a* has a scale value of 300 um=1 cm whereas FIG. 3*b* is three times the scale of the FIG. 3*a* (see scale 100 um=1 cm). The white areas of FIGS. 3*a* and 3*b* represent aluminum rich phase, 98 to 100 percent aluminum by weight, while the dark areas represent silicon rich, 99–100 weight percent of silicon. The silicon forms large primary silicon-rich cells and large acicular eutectic silicon-rich particles. These large silicon-rich particles reduce castability and further significantly increase wear during machining and performance.

Figure 4A:
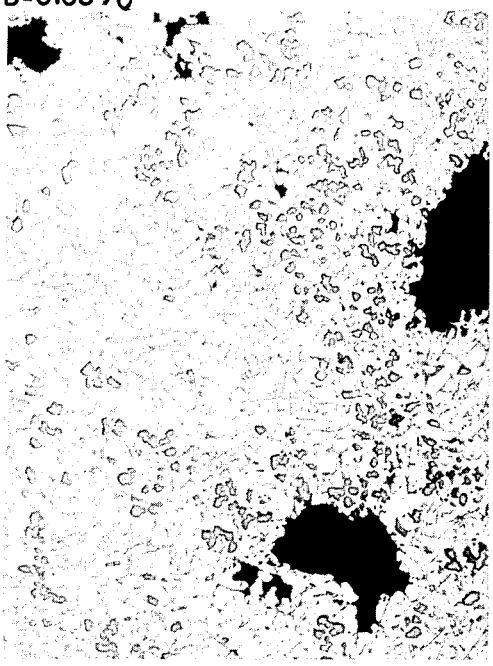
Figure 4B:
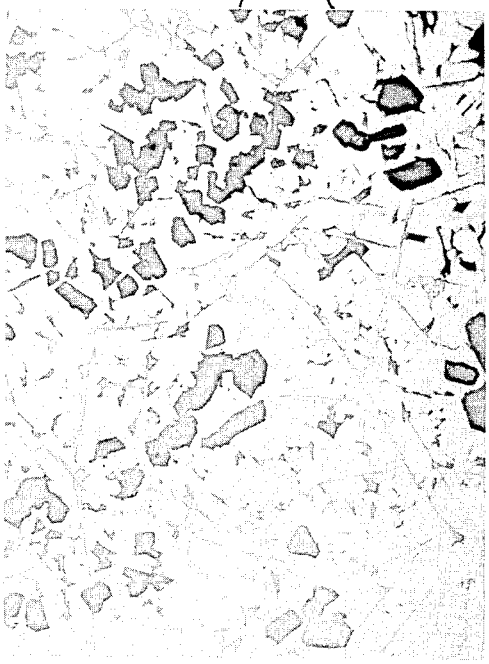

FIGS. 4*a* and 4*b* show the A390 alloy to which is added 0.18 percent by weight titanium and 0.3 percent by weight boron. FIG. 4*a* is to a 300 micron scale while FIG. 4*b* is to a 100 micron scale. Comparing FIG. 3*a* with FIG. 4*a* and comparing FIG. 3*b* with FIG. 4*b*, there can be seen to be some improvement in the refinement of Si-rich crystals, i.e. some reduction in the size of the cell-like and acicular silicon crystal.

Figure 5A:
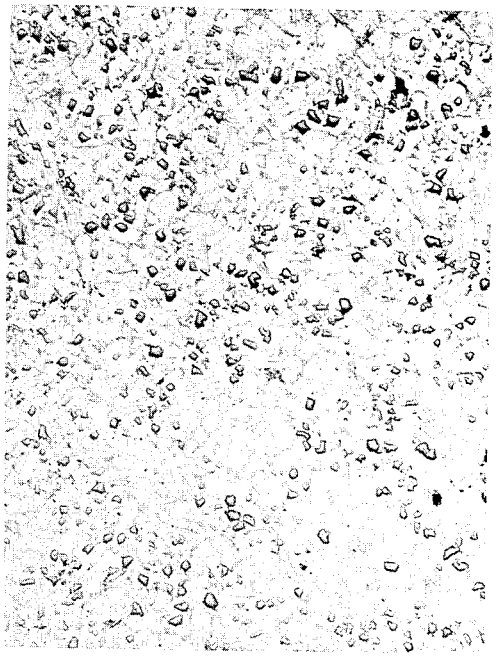
Figure 5B:
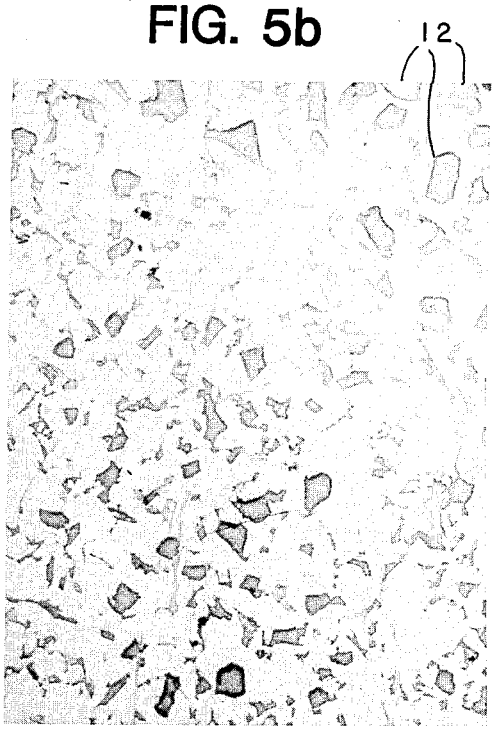

Comparing FIGS. 5*a* and 5*b* with FIGS. 4*a* and 4*b* a significant improvement is found in the refinement, number and distribution of silicon cells 12 of FIG. 5*b* as compared with the number and distribution of the silicon-rich cells 12 in FIG. 4*b*. More specifically, the cells 12 in FIG. 5*b* are finer in size and more uniformly distributed throughout the alloy. In addition, considering FIG. 5*b*, the acicular crystals 10 are significantly reduced in size as compared with the acicular crystals 10 of FIG. 4*b*.

Figure 6A:
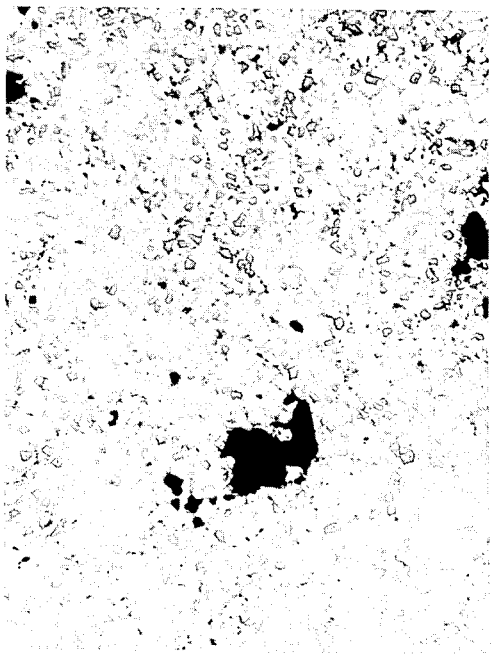
Figure 6B:
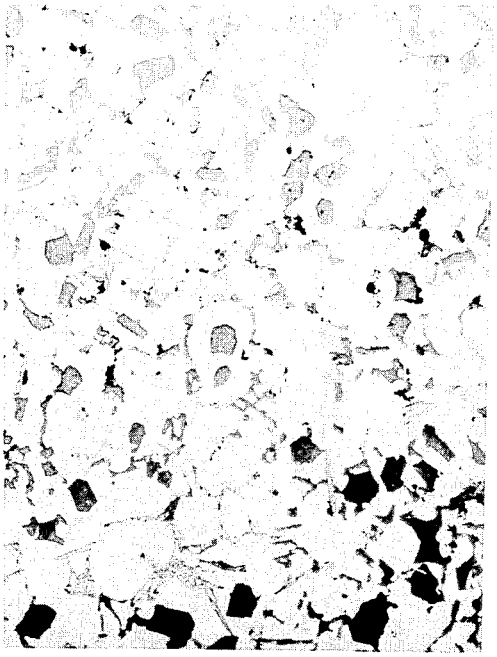

Comparing FIGS. 6*a* and 6*b* with FIGS. 4*a* and 4*b*, still further improvement can be seen. Note especially the refinement and number of the silicon cells 12 and their uniform distribution throughout the alloy as shown in FIG. 6*b*, compared with the significantly larger cells 12 and non-uniform distribution of said cells throughout the alloy as shown in FIG. 4*b*. The large acicular crystals 10 shown in FIG. 4*b* are either non-existent or significantly reduced in size as shown in FIG. 6*b*.

In addition to a consideration of the photomicrographs discussed hereinabove, the hypoeutectic and hypereutectic alloys formed in accordance with techniques of the present invention have been found to have significantly improved ductility and flowability in the melt state, as well as enhancement of the mechanical properties and particular ductility and wearability. In addition, both grain refinement and eutectic modification are both accomplished through the single step of the addition of titanium in the weight percent ranges set forth hereinabove for either hypoeutectic or hypereutectic alloys.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A master alloy for use in a hypereutectic casting alloy for improving grain refinement and eutectic modification consisting essentially of 76 to 88 weight percent aluminum; 8 to 4 weight percent titanium and 16 to 8 weight percent of silicon.

2. A metallic composition consisting essentially of a hypoeutectic aluminum-silicon alloy and titanium wherein the range of titanium is between 0.527 and 1.0 percent by weight.

3. A metallic composition consisting essentially of a hypoeutectic aluminum-silicon alloy and titanium in a range of from greater than 0.5 to 1.0 percent by weight; and further containing essentially 0.3 to 0.084 percent by weight of boron.

4. A hypereutectic casting aluminum-silicon alloy composition wherein grain refinement and eutectic modification is vastly improved through the addition of titanium to a hypereutectic aluminum-silicon casting alloy so that the resulting alloy consists essentially of a hypereutectic aluminum-silicon alloy wherein the range of titanium is between 0.527 and 1.0 percent by weight.

* * * * *